US009345382B2

(12) United States Patent
Carr et al.

(10) Patent No.: US 9,345,382 B2
(45) Date of Patent: May 24, 2016

(54) DISHWASHER WITH SLIDING DISH RACK

(71) Applicant: BSH Home Appliances Corporation, Irvine, CA (US)

(72) Inventors: Casey Carr, New Bern, NC (US); Mike Holmes, Bethel, NC (US); Jeff Vogus, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 149 days.

(21) Appl. No.: 13/921,242

(22) Filed: Jun. 19, 2013

(65) Prior Publication Data

US 2014/0375190 A1 Dec. 25, 2014

(51) Int. Cl.

*A47B 77/08* (2006.01)
*A47B 77/06* (2006.01)
*A47L 15/50* (2006.01)

(52) U.S. Cl.

CPC ..... *A47L 15/507* (2013.01)

(58) Field of Classification Search

CPC ..... A47L 15/50; A47L 15/506; A47L 15/507
USPC ..... 312/228.1
See application file for complete search history.

(56) References Cited

U.S. PATENT DOCUMENTS 455,883 A * 7/1891 Merritt ..... 4/476
1,254,287 A * 1/1918 Sterling ..... A47L 19/04 211/41.1
1,711,221 A * 4/1929 Blakeslee ..... 134/194
2,266,870 A * 12/1941 Kraeft ..... 312/323
2,622,757 A * 12/1952 Nydahl ..... 220/488
2,889,054 A * 6/1959 Wheeler ..... F25D 25/02 211/153
2,910,207 A * 10/1959 Andrew ..... 220/488
3,044,842 A * 7/1962 Mercer et al. ..... 312/228.1
3,099,585 A * 7/1963 Kahn ..... 134/6
3,430,638 A * 3/1969 Brollo ..... 134/112
3,454,744 A 7/1969 Vonderhaar
3,977,389 A * 8/1976 Ondrasik, II ..... 126/337 R
4,494,802 A 1/1985 Henson
5,037,165 A 8/1991 Rapp et al.
5,230,554 A * 7/1993 Camilleri ..... 312/334.6
6,626,509 B2 9/2003 Remmers
7,159,415 B2 1/2007 Wood
7,347,516 B2 3/2008 Hay
7,815,265 B2 * 10/2010 Lee ..... 312/228.1
2001/0032825 A1 * 10/2001 Hess et al. ..... 211/41.8
2010/0051069 A1 3/2010 Schessl et al.

FOREIGN PATENT DOCUMENTS

EP 1336356 A2 8/2003
JP 2009207795 A 9/2009

* cited by examiner

*Primary Examiner* — Daniel J Troy
*Assistant Examiner* — Timothy M Ayres
(74) *Attorney, Agent, or Firm* — James E. Howard; Andre Pallapies

(57) ABSTRACT

A domestic dishwasher includes a wire rack that does not include any rolling elements that would otherwise allow the rack to roll between an extended position and a retracted position. Instead of rolling elements, the rack includes sliding surfaces that slide along corresponding surfaces inside the dishwasher and/or on a dishwasher door. The rack may be a lowermost rack.

24 Claims, 7 Drawing Sheets

DISHWASHER WITH SLIDING DISH RACK

FIELD OF THE TECHNOLOGY

The present technology relates to a domestic dishwasher. More particularly, the present technology relates to an enhancement for a dishwasher where a rack for dishes reduces cost and improves reliability of the rack.

BACKGROUND OF THE INVENTION

In the modern kitchen, one common appliance is the dishwasher, or in more specific terms, the automatic dishwasher. Most automatic dishwashers share certain basic components. There is a compartment in which the dishes or crockery are placed and enclosed for treatment or washing. Commonly, there is at least one rack to hold the items to be cleaned. A hinged door or sliding drawer is commonly used to enclose the compartment and its contents, and the door or drawer frequently includes a handle. There are commonly a number of nozzles for spraying water to facilitate the cleaning within the compartment and a basin that collects water sprayed from the nozzles. A drain is incorporated into the basin and the drain is connected to a hose to allow water to be removed from the dishwasher. Lastly, there is a dispenser for detergent to release detergent into the compartment during the treatment process and the detergent dispenser will have a cover to hold the detergent therein. Of course, it is to be understood that these components are common and basic, and that individual appliances will differ in the make-up of their components.

The rack may include wheels or rollers so that the rack can roll out of the compartment to facilitate insertion and removal of dishes from the dishwasher and/or the rack.

Including wheels and/or rollers on a dishwasher rack has shortcomings. For example, the wheels and/or rollers increase cost, at least because of additional parts and assembly time, which is undesirable. For example, in addition to wheels and/or rollers, bearings may be required along with the wheels and/or rollers. Bearings also increase cost. Also, the wheels and/or rollers, along with any associated bearings, can fail, which is also undesirable.

A need has developed to address one or more shortcomings of the prior art.

BRIEF SUMMARY OF THE INVENTION

The present technology addresses one or more the shortcomings of the prior art.

An aspect of the present technology includes a dishwasher with a rack that is slidable into and out of a compartment of the dishwasher without any rolling elements.

Another aspect of the present technology includes a domestic dishwasher comprising a compartment including an opening adapted to facilitate insertion and removal of dishes; a door that closes the opening; a first rack for holding the dishes, the first rack being adapted to fit within the compartment in a retracted position when the door is closed, the first rack being movable from the retracted position to an extended position when the door is open, wherein when the door is in an open position, the first rack is slidable at least partially out of the compartment through the opening, and the first rack and the compartment do not include any rolling elements that would otherwise allow the first rack to roll between the extended position and the retracted position.

In examples, (a) the first rack is a lower-most rack in the compartment; (b) the door is hinged along a bottom side of the opening; (c) the dishwasher comprises a second rack for holding the dishes, the second rack being suspended above the first rack; (d) the first rack is slidable onto the door when the door is open; (e) the first rack includes a first sliding surface and the compartment includes a second sliding surface, and the first sliding surface and the second sliding surface are slidingly-engaged while the first rack is sliding out of the compartment; (f) the first sliding surface comprises a horizontal bar; (g) the horizontal bar is perpendicular to a side wall of the compartment; (h) the horizontal bar is parallel to a side wall of the compartment; (i) the second sliding surface is horizontal; (j) the door includes a third sliding surface that acts as an extension of the second sliding surface when the door is open; (k) the dishwasher comprises a gap between the second sliding surface and the third sliding surface when the door is fully open; (l) the first rack includes a third sliding surface and the compartment includes a fourth sliding surface, and the third sliding surface and the fourth sliding surface together prevent the first rack from moving beyond a predetermined limit in a first lateral direction but allow uninhibited movement in a direction opposite to the first lateral direction; (m) the first rack includes a fifth sliding surface and the compartment includes a sixth sliding surface, and the fifth sliding surface and the sixth sliding surface together prevent the first rack from moving beyond a second predetermined limit in the direction opposite to the first lateral direction and allow uninhibited movement in the first lateral direction; (n) the third sliding surface comprises a vertical bar; (o) the third sliding surface comprises a horizontal bar; (p) the fourth sliding surface is vertical; (q) the first sliding surface rests on the second sliding surface when the first rack is fully inserted into the compartment; (r) the first rack comprises a plurality of first sliding surfaces and the compartment comprises a plurality of second sliding surfaces; (s) the first rack comprises a plurality of first sliding surfaces and the compartment comprises two second sliding surfaces; (t) at least one of the first sliding surface and the second sliding surface includes a low friction coating or plating; (u) the door comprises a stop that limits travel of the first rack when the first rack slides out of the compartment and onto the door, and/or (v) the first rack is a wire rack.

Another aspect of the present technology includes a domestic dishwasher comprising a compartment including an opening adapted to facilitate insertion and removal of the dishes and including a first load bearing surface that is fixed with respect to the compartment; a door that closes the opening, the door being hinged along a bottom side of the opening and the door including a second load bearing surface that is fixed with respect to the door; a first rack for holding the dishes, the first rack including a third load bearing surface that is fixed with respect to the first rack; and a second rack for holding the dishes, the second rack being suspended above the first rack, wherein the first rack is slidable between a first position within the compartment and a second position at least partially external to the compartment, the first load bearing surface and the third load bearing surface contact one another and slide with respect to one another during a transition from the first position to the second position, and the second load bearing surface and the third load bearing surface contact one another and are slidable with respect to one another when the door is open and the first rack is in the second position.

In examples, (a) the third load bearing surface transitions from contacting the first load bearing surface to contacting the second load bearing surface during a transition from the first position to the second position; (b) the third load bearing surface contacts both the first load bearing surface and the second load bearing surface simultaneously at an intermediate position during the transition from the first position to the second position; (c) the third load bearing surface contacts neither the first load bearing surface nor the second load bearing surface at an intermediate position during the transition from the first position to the second position; (d) the first rack is disposed at least partially on the door in the second position; (e) at least one of the third load bearing surface or the combination of the first load bearing surface and the second load bearing surface include a low friction coating or plating; (f) the first load bearing surface and the second load bearing surface are substantially planar and the third load bearing surface is part of a bar; (g) a length of the bar is disposed parallel to a direction that the first rack slides out of the compartment; (h) a length of the bar is disposed perpendicular to a direction that the first rack slides out of the compartment; (i) a length of the bar is disposed transverse to a direction that the first rack slides out of the compartment; and/or (j) the bar is substantially cylindrical.

Other aspects, features, and advantages of this technology will become apparent from the following detailed description when taken in conjunction with the accompanying drawings, which are a part of this disclosure and which illustrate, by way of example, principles of this technology.

DETAILED DESCRIPTION

The following description is provided in relation to several examples which may share common characteristics and features. It is to be understood that one or more features of any one example may be combinable with one or more features of the other examples. In addition, any single feature or combination of features in any of the examples may constitute additional examples.

Throughout this disclosure, terms such as first, second, third, etc. are used. However, these terms are not intended to be limiting or indicative of a specific order, but instead are used to distinguish similarly described features from one another.

Figure 1:
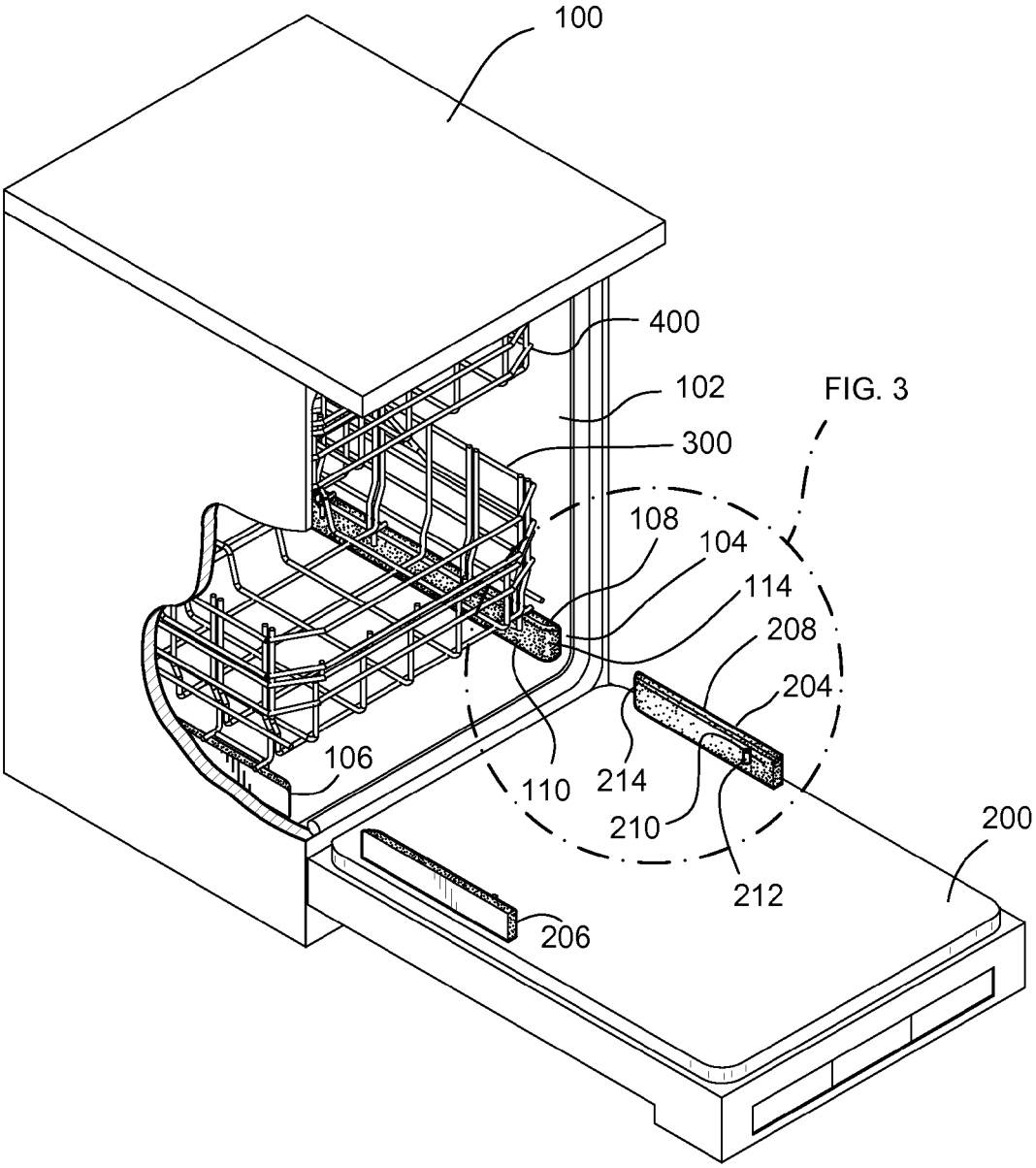
FIG. 1 is a perspective view of a dishwasher.

FIG. 1 shows a perspective view of a dishwasher 100, e.g., a domestic dishwasher, in an open condition with a portion of a wall broken out so that interior aspects of the dishwasher are visible. The dishwasher 100 includes a compartment 102 internal to the dishwasher 100. The compartment 102 includes an opening that is closable by a door 200. Although door is used throughout this description, any suitable closure, such as a drawer, may also be used. As illustrated, a first rack 300 and a second rack 400 are internal to the compartment 102, with the second rack 400 being suspended over the first rack 300. Both the first rack 300 and the second rack 400 are illustrated as metal wire racks and may be coated with a protective layer to protect the metal wire from degradation over the life of the dishwasher 100.

Domestic dishwashers differ from commercial dishwashers in several respects. For example, domestic dishwashers may have much longer cycle times than commercial dishwashers, e.g., around 75-150 minutes versus around 1-4 minutes, respectively, for a typical washing operation. Domestic dishwashers are often designed to be installed under a counter top and blend in with or accentuate the kitchen decor, whereas commercial dishwashers are typically free standing metal units without regard to the surrounding decor.

Figure 3:
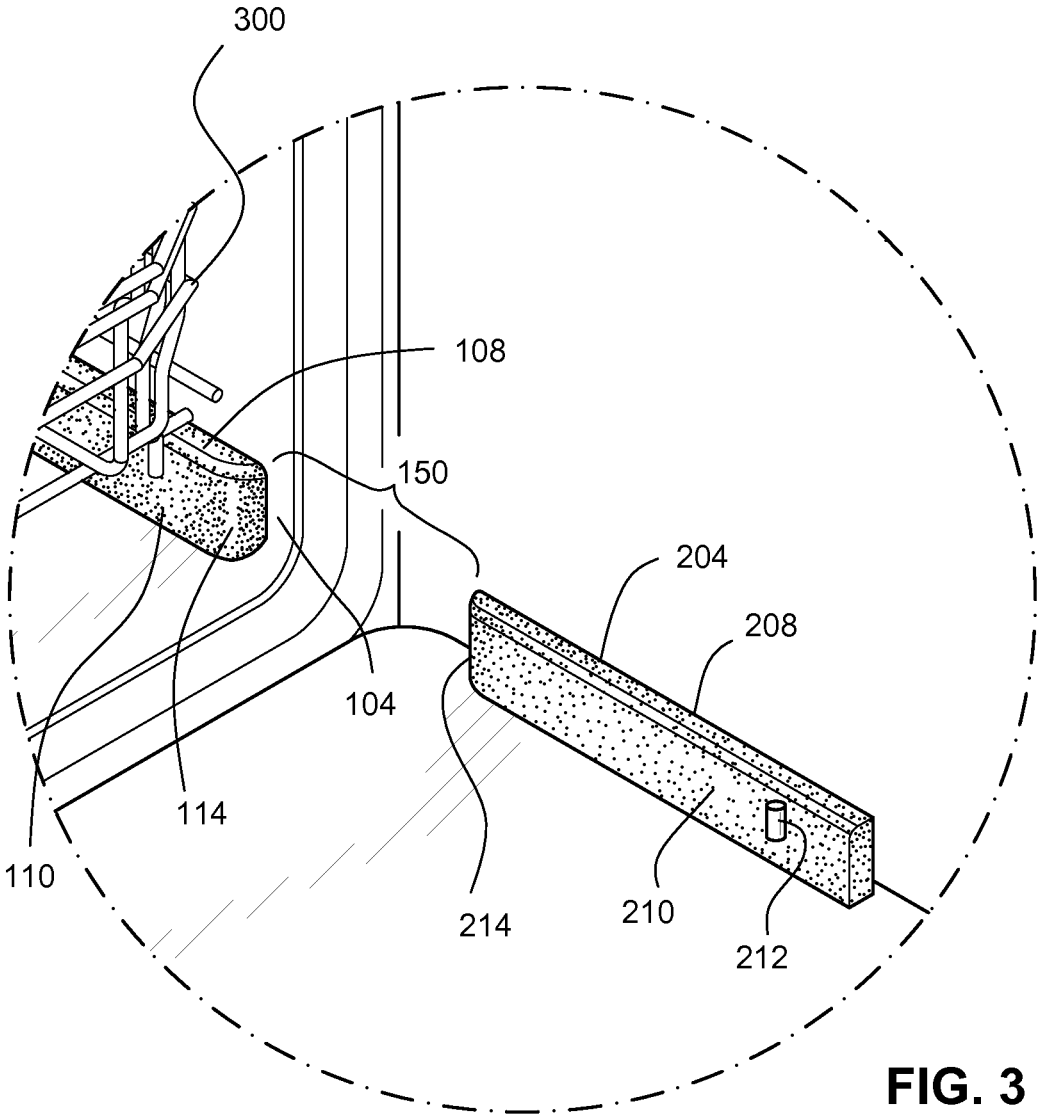
FIG. 3 is an enlarged view of a portion of FIG. 1.

In the illustrated examples, the compartment 102 includes two sliding members, a first sliding member 104 and a second sliding member 106, although a single sliding member or more than two sliding members are contemplated. FIG. 3 illustrates part of the first sliding member 104 enlarged for clarity. In the illustrated examples, the first sliding member 104 and the second sliding member 106 are substantially mirror images of one another. Thus, although only the first sliding member 104 is further described hereinafter, the description of the first sliding member 104 is also applicable to the second sliding member 106 except as explicitly noted herein.

The first sliding member 104 includes an upper sliding surface 108 and a side sliding surface 110. In an example, the upper sliding surface 108 is substantially horizontal. Substantially horizontal encompasses at least a surface that is perfectly horizontal as well as a surface that includes some imperfections such as waviness and includes tolerances due to manufacturing and measuring process limitations. Substantially horizontal also encompasses a surface with a slight angle, for example, from 0-5° or about 1°. The angle can be from front to back, back to front or side to side. In an example, the angle is from side to side and facilitates the drainage of water off of the upper sliding surface 108.

In an example, the side sliding surface 110 is substantially vertical. Substantially vertical encompasses at least a surface that is perfectly vertical as well as a surface that includes some imperfections such as waviness and includes tolerances (+/− up to about 1°-10° or more) due to manufacturing and measuring process limitations.

The door 200 includes a first door sliding member 204 and a second door sliding member 206. As illustrated, the door is hinged along a bottom edge of the door 200 so that the door 200 swings open to a substantially horizontal position. Although two door sliding members are illustrated, more or less are contemplated. In the illustrated examples, the number of door sliding members corresponds to the number of sliding members in the compartment 102. By having the same number of door sliding members as sliding members in the compartment 102, the first rack 300 (discussed in detail below), can readily slide from the compartment 102 to the door 200.

FIG. 3 illustrates the first door sliding member 204 enlarged for clarity. The first door sliding member 204 and the second door sliding member 206 are illustrated generally in the form of rectangular prisms. However, this shape is chosen for ease of illustration. Other shapes are also contemplated. For example, the door sliding members could be formed as part of other functional or non-functional surfaces of the door 200.

As illustrated, the first door sliding member 204 and the second door sliding member 206 are substantially mirror images of one another. Thus, although only the first door sliding member 204 is further described hereinafter, the description of the first door sliding member 204 is also applicable to the second door sliding member 206 except as explicitly noted herein.

The first door sliding member 204 includes an upper sliding surface 208 and a side sliding surface 210. In an example, the upper sliding surface 208 is substantially horizontal when the door 200 is open. In another example when the door is open, the upper sliding surface 208 may be angled so that a portion of the upper sliding surface 208 nearest the compartment 102 is lower than a portion of the upper sliding surface 208 that is further away from the compartment 102 so that the first rack 300 has a tendency to slide into the compartment 102.

In an example, the side sliding surface 210 is substantially vertical. As illustrated, the side sliding surface 210 includes a stop 212 that limits travel of the first rack 300 as it slides on the door sliding member 204. The stop 212 is illustrated as a protrusion on the side sliding surface 210 but could also take other forms and locations that limit the travel of the first rack 300. For example, the stop 212 could be located on the upper sliding surface 208. The stop 212 could also take the form of a depression, or multiple depressions, instead of a protrusion. For example, if the stop 212 is located on the upper sliding surface 208, a portion of the first rack 300 could mate with a depression such that the weight of the first rack 300 would tend to prevent movement of the first rack 300.

As best seen in FIG. 3, when the door 200 is open, a gap 150 is present between the first sliding member 104 and the first door sliding member 204. The size or distance of the gap 150 can be determined based upon eliminating interference when the door 200 is closed and minimizing the size or distance to allow smooth transition of the first rack 300 from the first sliding member 104 to the first door sliding member 204. Thus, the first door sliding member 204 can act as an extension of the first sliding member 104 when the door 200 is open.

Figure 2:
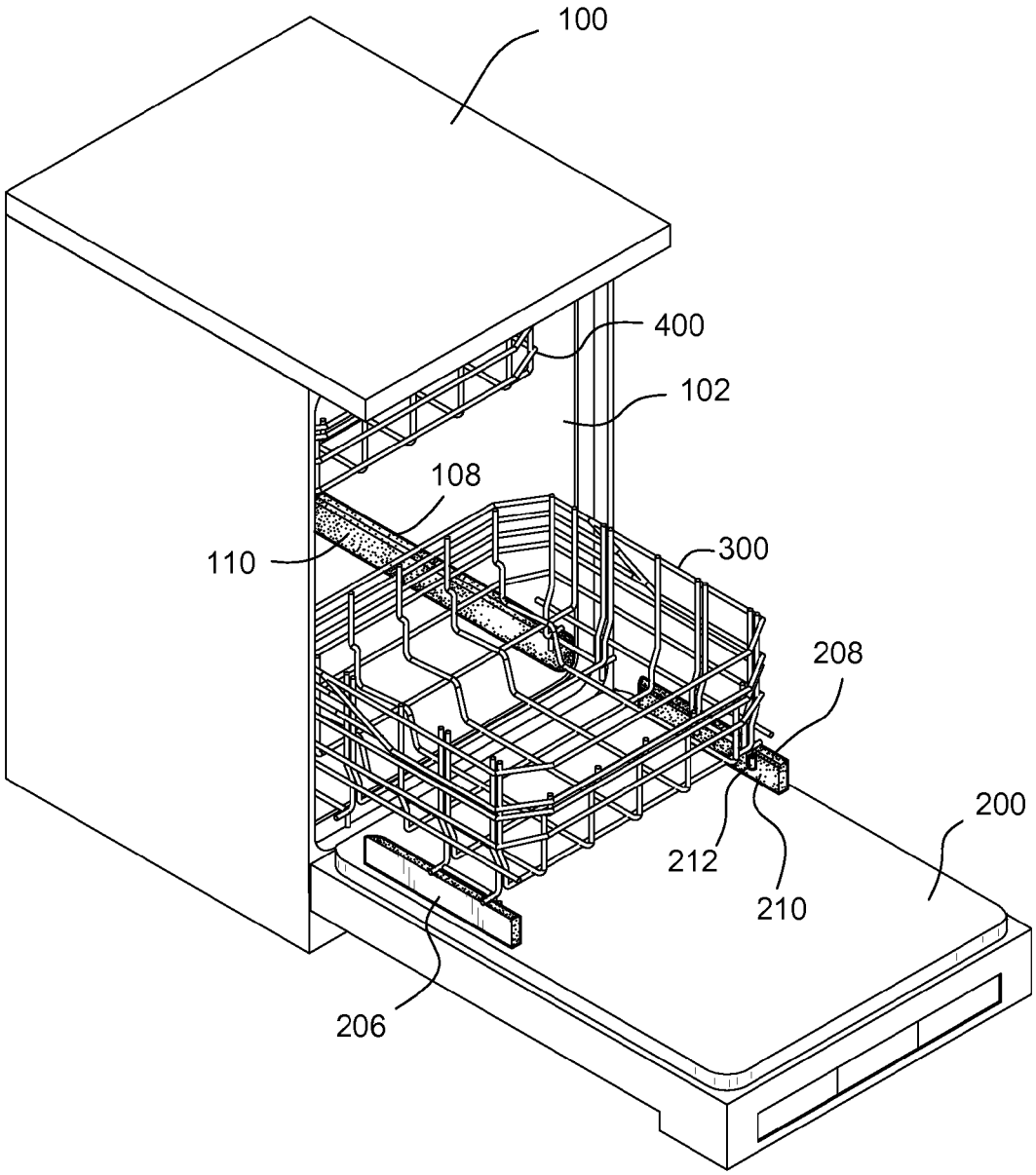
FIG. 2 is a perspective view of a dishwasher.
Figure 4:
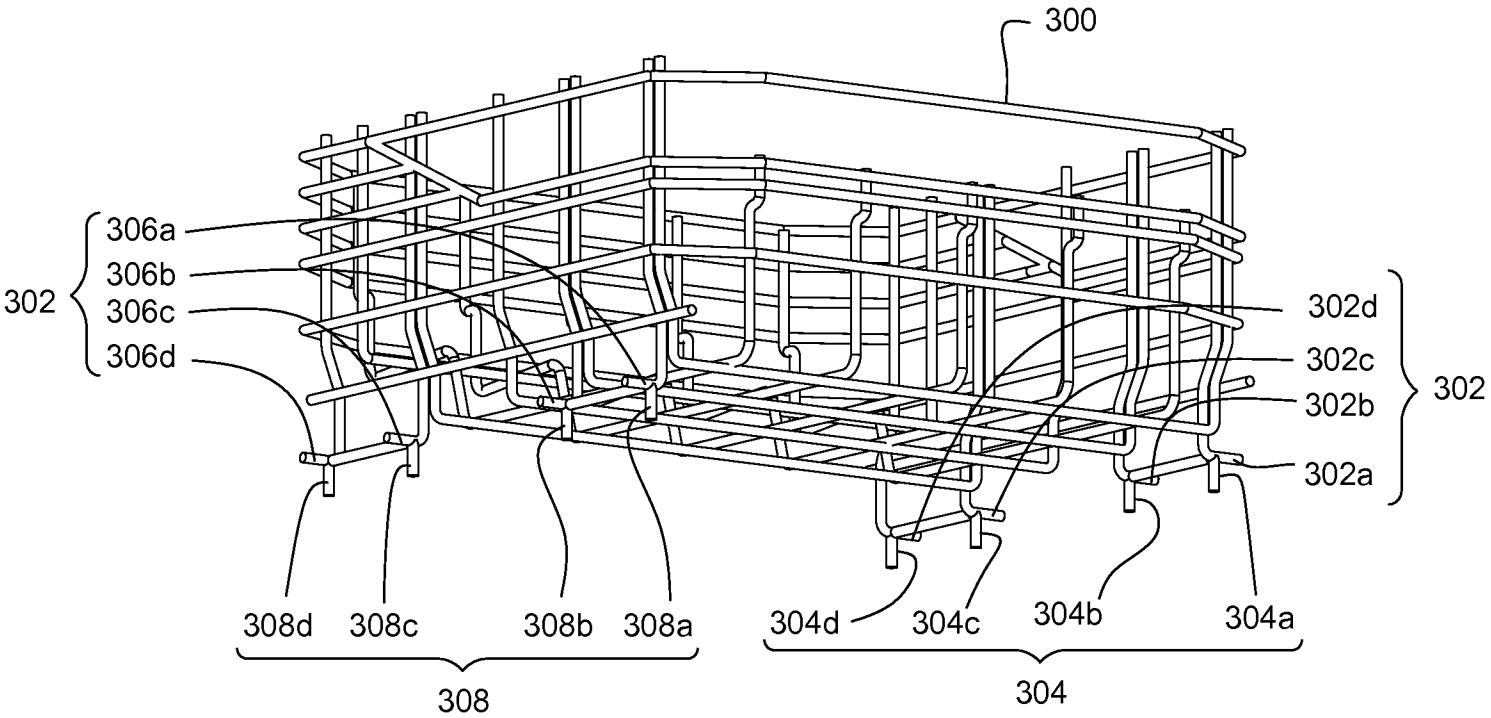
FIG. 4 is a perspective view of a rack.

The first rack 300 is illustrated in FIG. 1 in a retracted position and in FIG. 2 in an extended position. FIG. 4 illustrates the first rack 300 in isolation. As is evident, the first rack 300 does not include any wheels, rollers, or other rolling elements that would allow the first rack 300 to roll between the extended position and the retracted position. Instead, the first rack 300 is adapted to slide on the first and second sliding members 104, 106 and the first and second door sliding members 204, 206.

In an example best seen in FIG. 4, the first rack 300 includes a first sliding surface 302 illustrated as four horizontal bars 302*a*, 302*b*, 302*c*, 302*d* that are substantially perpendicular to a side wall of the compartment 102. Alternatively, each of the four horizontal bars 302*a*, 302*b*, 302*c*, 302*d* can individually be considered a sliding surface. Similarly, the first rack 300 includes a second sliding surface 306 illustrated as four horizontal bars 306*a*, 306*b*, 306*c*, 306*d*. Although four bars are illustrated throughout the figures, more or less are contemplated as would be dictated by the needs of a given rack.

The first rack 300 is also illustrated as including a third sliding surface 304 illustrated as four substantially vertical bars 304*a*, 304*b*, 304*c*, 304*d*. Alternatively, each of the four vertical bars 304*a*, 304*b*, 304*c*, 304*d* can individually be considered a sliding surface. Similarly, the first rack 300 includes a fourth sliding surface 308 illustrated as four vertical bars 308*a*, 308*b*, 308*c*, 308*d*. Although four bars are illustrated throughout the figures, more or less are contemplated as would be dictated by the needs of a given rack.

As can be appreciated by at least FIG. 3, when the third sliding surface 304 contacts the side sliding surface 110, the third sliding surface 304 will limit travel of the first rack 300 as the first rack 300 moves toward a wall of the compartment 102 that is nearest the third sliding surface 304 but will allow uninhibited movement in an opposite direction. Similarly, the fourth sliding surface 308 will limit travel of the first rack 300 in the opposite direction. Thus, the combination of the third and fourth sliding surfaces 304, 308 restrict movement of the first rack 300 in lateral directions while allowing the first rack 300 to move into and out of the compartment 102. For example, the first rack 300 may have a retracted position where the first rack 300 is centered within the compartment 102. If a clearance is provided between the third sliding surface 304 and the side sliding surface 110 when the first rack 300 is centered, then the combination of the third and fourth sliding surfaces 304, 308 along with the side sliding surfaces 110 define a range or predetermined limit of lateral motion of the first rack 300. The range of lateral motion may be about 1 mm in either direction or 2 mm total range. In another example, one or more lateral surface of the horizontal bars 302*a*, 302*b*, 302*c*, 302*d* could provide similar restriction to lateral movement.

Regardless of the way in which lateral movement is restricted, the first rack 300 can be provided with clearance between outer-most lateral portions of the first rack 300 and inner walls of the compartment 102. In an example, the clearance is such that when the first rack 300 is at either end of the predetermined limit of lateral motion, the outer-most lateral portions of the first rack 300 will not touch the inner walls of the compartment 102. For example, the first rack 300 may be provided with 2 mm clearance on both lateral sides of the first rack 300 when the first rack 300 is centered.

Figure 5:
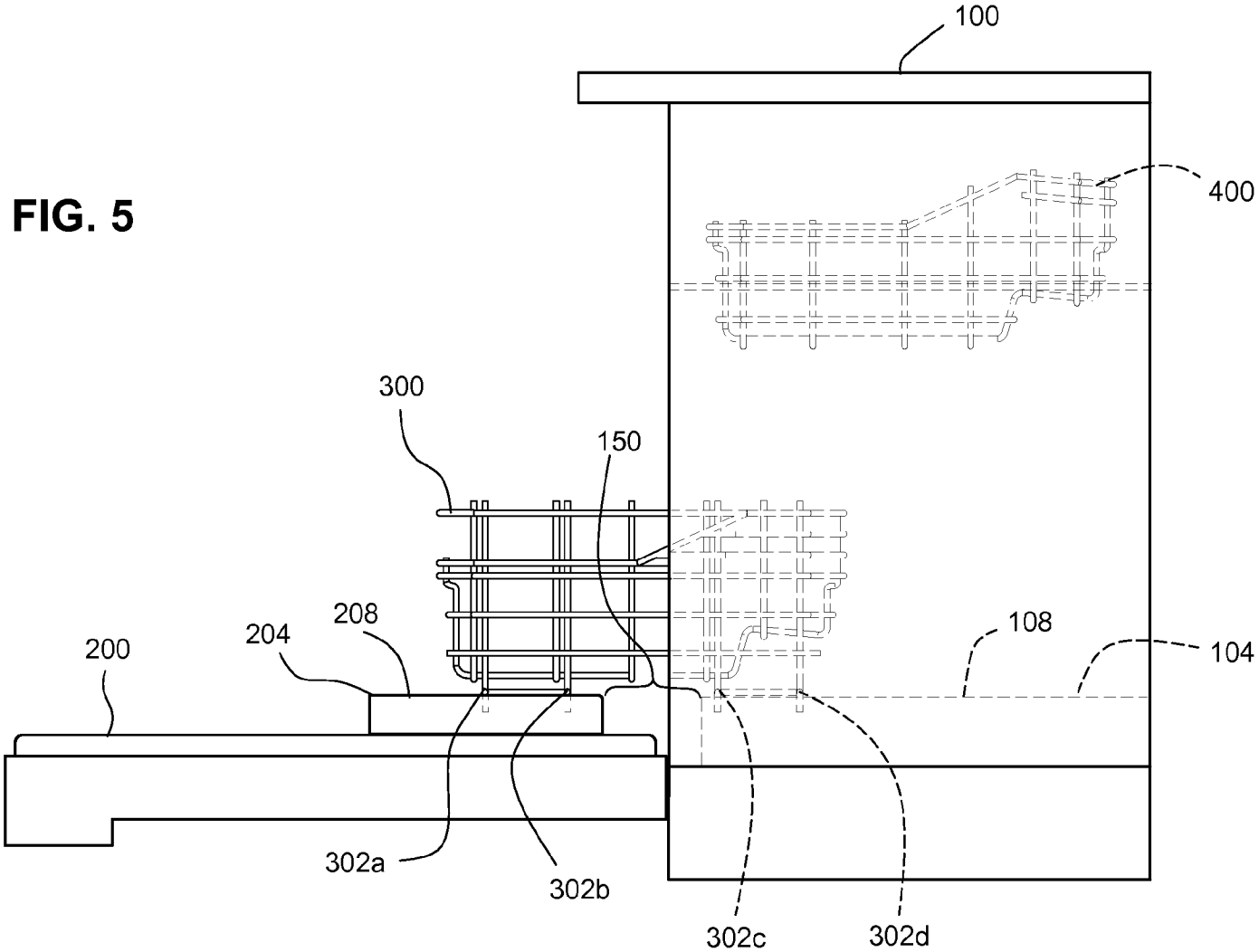
FIG. 5 is a side view of a dishwasher.

FIG. 5 illustrates the dishwasher 100 from the side with the first rack 300 in a partially extended position. Two of the horizontal bars 302*a*, 302*b* are illustrated as being disposed on the upper sliding surface 208 and two of the horizontal bars 302*c*, 302*d* are illustrated as being disposed on the upper sliding surface 108. Thus, as the first rack 300 slides out of the compartment 102, the horizontal bar 302*a* transitions from the upper sliding surface 108 to the gap 150 and then to the upper sliding surface 208. One or all other horizontal bars 302*b*, 302*c*, 302*d* may have a similar transition as the first rack 300 slides out of the compartment 102. Conversely, at least one horizontal bar, such as horizontal bar 302*d*, may remain in contact with the upper sliding surface 108 even when the first rack 300 is at an outermost position.

As illustrated throughout the figures, when the rack is not loaded with dishes, only the weight of the first rack 300 keeps the first rack 300 in contact with one or both of the upper sliding surfaces 108, 208. Thus, the first rack 300 could be picked up and removed from the dishwasher 100. In an unillustrated example, the upper sliding surfaces 108, 208 could be in the form of grooves that restrain the first rack 300 from moving upwards.

Figure 6:
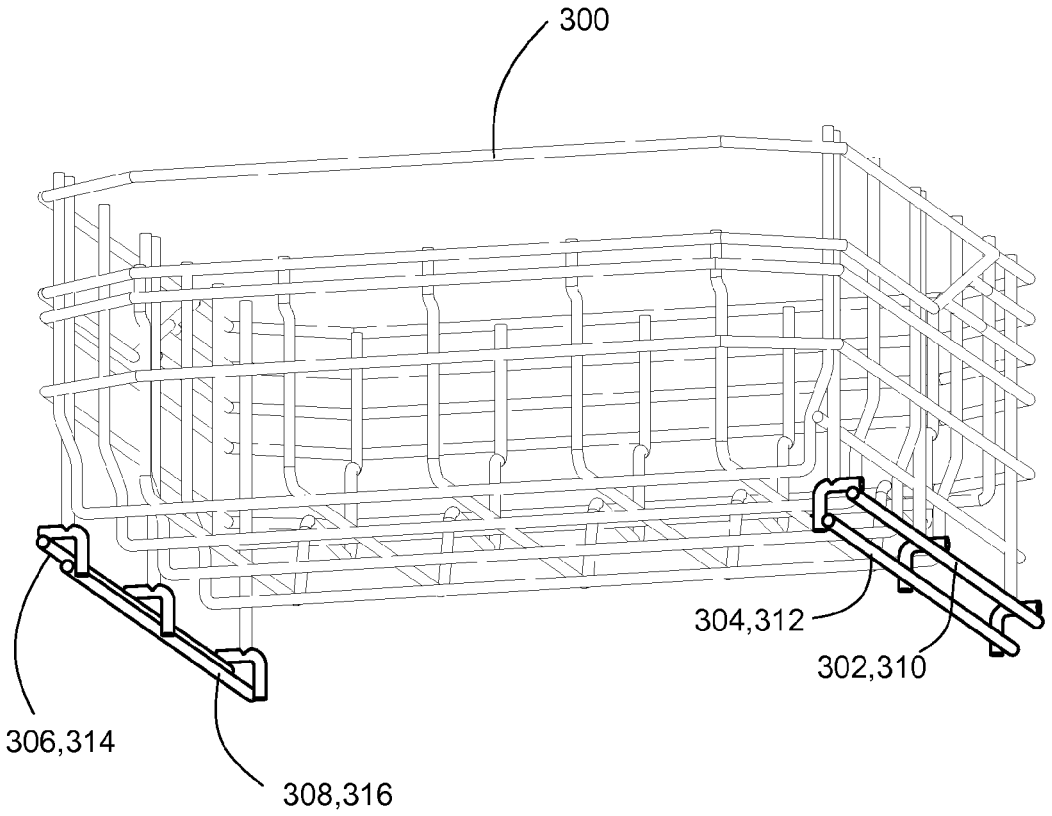
FIG. 6 is a perspective view of a rack.
Figure 7:
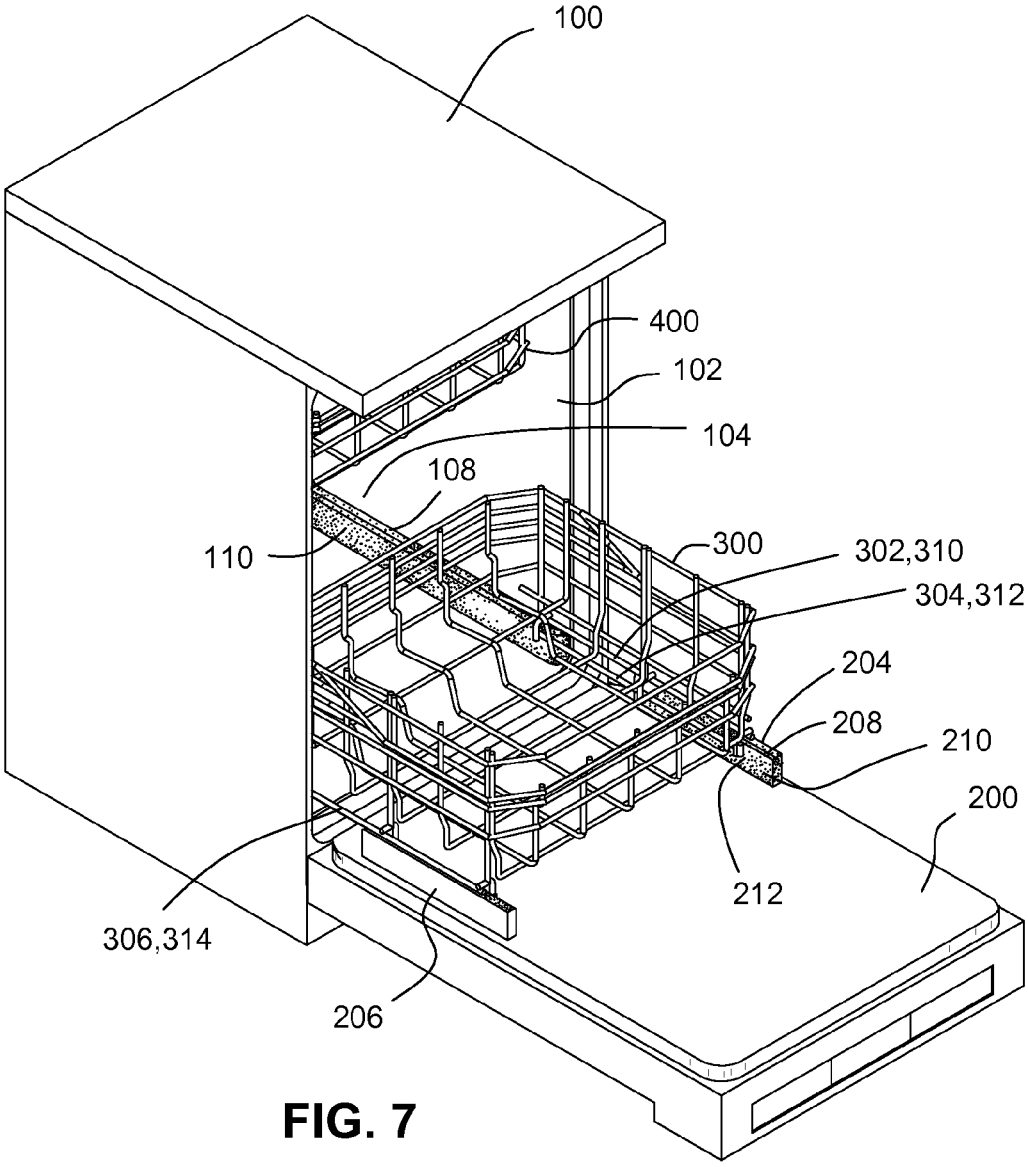
FIG. 7 is a perspective view of a dishwasher.

FIGS. 6 and 7 illustrate another example of the present technology. FIGS. 6 and 7 are substantially the same as the FIGS. 2 and 4 except that first sliding surface 302 is composed of a single horizontal bar 310 that has a length parallel to a sliding direction of the first rack 300. Similarly, the second sliding surface 306, third sliding surface 304 and fourth sliding surface 308 are composed of horizontal bars 314, 312, and 316, respectively. Including such horizontal bars instead of the shorter bars of FIGS. 1-5 may be advantageous in guiding the first rack 300 as the first rack 300 transitions from the first sliding member 104 to the first door sliding member 204. For example, one or more of the horizontal bars 310, 312, 314, 316 may be long enough to span the gap 150 and simultaneously contact surfaces on both sides of the gap 150.

The first sliding member 104 and first door sliding member 204 may include geometry to aid in the transition of the first rack 300, illustrated as rounded corners 114, 214. The rounded corners 114, 214 are illustrated as vertically rounded surfaces, but may be equally applicable to horizontal surfaces as well. With such rounded surfaces, the first rack 300 may be guided into position if misaligned during a sliding operation.

In an example of the present technology, one or more of the sliding members 104, 106, the door sliding members 204, 206 and the sliding surfaces 302, 304, 306, 308 may include a low friction surface or coating to improve the ability of the surfaces to slide past one another. The particular low friction surface or coating should be chosen with the environmental conditions internal to a dishwasher in mind, but otherwise can be chosen from any number of lower friction surfaces or coatings. For example, food grade Delrin® (polyoxymethylene) or Teflon® (polytetrafluoroethylene) may provide a suitable low friction surface or coating. The surface or coating can be applied to the entire first rack 300 and/or compartment 102 and/or door 200. Alternatively, the low friction surface or coating can be selectively applied to appropriate sliding surfaces. One way to achieve selective application would be the application of low friction caps, e.g., on the ends, of the one or more of the horizontal bars 302*a*, 302*b*, 302*c*, 302*d*, 306*a*, 306*b*, 306*c*, 306*d* and/or vertical bars 304*a*, 304*b*, 304*c*, 304*d*, 308*a*, 308*b*, 308*c*, 308*d*.

While the present technology has been described in connection with several practical examples, it is to be understood that the technology is not to be limited to the disclosed examples, but on the contrary, is intended to cover various modifications and equivalent arrangements included within the spirit and scope of the technology.

What is claimed is:

1. A domestic dishwasher comprising:

a compartment including an opening adapted to facilitate insertion and removal of dishes;

a door that closes the opening;

a first rack for holding the dishes, the first rack being adapted to fit within the compartment in a retracted position when the door is closed, the first rack being movable from the retracted position to an extended position when the door is open, wherein when the door is in an open position, the first rack is slidable at least partially out of the compartment through the opening, the first rack and the compartment do not include any rolling elements that would otherwise allow the first rack to roll between the extended position and the retracted position, the first rack includes a plurality of first sliding surfaces, each comprising one of a plurality of horizontal wires that are fixed with respect to a side of the first rack and are transverse to a side wall of the compartment, the compartment includes a second sliding surface, the first sliding surfaces and the second sliding surface are slidingly-engaged while the first rack is sliding out of the compartment, the first rack includes a plurality of third sliding surfaces, each comprising one of a plurality of vertical wires that each extend below the plurality of horizontal wires and that each are fixed with respect to the side of the first rack, and the compartment includes a fourth sliding surface extending vertically below the second sliding surface, the plurality of the third sliding surfaces and the fourth sliding surface together prevent the first rack from moving beyond a predetermined limit in a first lateral direction but allow uninhibited movement in a direction opposite to the first lateral direction, and the first rack is slidable onto the door when the door is open.

2. The domestic dishwasher according to claim 1, wherein the first rack is a lower-most rack in the compartment.

3. The domestic dishwasher according to claim 1, wherein the door is hinged along a bottom side of the opening.

4. The domestic dishwasher according to claim 1, further comprising a second rack for holding the dishes, the second rack being suspended above the first rack.

5. The domestic dishwasher according to claim 1, wherein the horizontal wire is perpendicular to a side wall of the compartment.

6. The domestic dishwasher according to claim 1, wherein the second sliding surface is horizontal.

7. The domestic dishwasher according to claim 1, wherein the door includes a fifth sliding surface that acts as an extension of the second sliding surface when the door is open.

8. The domestic dishwasher according to claim 7, further comprising a gap between the second sliding surface and the fifth sliding surface when the door is fully open.

9. The domestic dishwasher according to claim 1, wherein the first rack includes a sixth sliding surface and the compartment includes a seventh sliding surface, and the sixth sliding surface and the seventh sliding surface together prevent the first rack from moving beyond a second predetermined limit in the direction opposite to the first lateral direction and allow uninhibited movement in the first lateral direction.

10. The domestic dishwasher according to claim 1, wherein the plurality of first sliding surface rests on the second sliding surface when the first rack is fully inserted into the compartment.

11. The domestic dishwasher according to claim 1, wherein the compartment comprises a plurality of second sliding surfaces.

12. The domestic dishwasher according to claim 1, wherein the comprises the compartment comprises two second sliding surfaces.

13. The domestic dishwasher according to claim 1, wherein at least one of (a) the plurality of first sliding surfaces and (b) the second sliding surface includes a low friction coating or plating.

14. The domestic dishwasher according to claim 1, wherein the door comprises a stop that limits travel of the first rack when the first rack slides out of the compartment and onto the door.

15. The domestic dishwasher according to claim 1, wherein the first rack is a wire rack.

16. A domestic dishwasher comprising:

a compartment including an opening adapted to facilitate insertion and removal of dishes and including a first load bearing surface that is fixed with respect to the compartment;

a door that closes the opening, the door being hinged along a bottom side of the opening and the door including a second load bearing surface that is fixed with respect to the door;

a first rack for holding the dishes, the first rack including at least three third load bearing surfaces that are fixed with respect to the first rack and discrete from one another, the third load bearing surfaces comprising wire, and including at least one downwardly extending wire that extends below the third load bearing surfaces and is configured to restrict lateral movement of the first rack; and a second rack for holding the dishes, the second rack being suspended above the first rack, wherein the first rack is slidable between a first position within the compartment and a second position at lease partially external to the compartment, the first load bearing surface and the third load bearing surfaces contact one another and slide with respect to one another during a transition from the first position to the second position, the second load bearing surface and at least one of the third load bearing surfaces contact one another and are slidable with respect to one another when the door is open and the first rack is in the second position, and the at least one of the third load bearing surfaces contacts neither the first load bearing surface nor the second load bearing surface when the first rack is at an intermediate position during the transition from the first position to the second position.

17. The domestic dishwasher according to claim 16, wherein at least two of the third load bearing surfaces transition from contacting the first load bearing surface to contacting the second load bearing surface during a transition from the first position to the second position.

18. The domestic dishwasher according to claim 16, wherein the first rack is disposed at least partially on the door in the second position.

19. The domestic dishwasher according to claim 16, wherein at least one of (a) the third load bearing surfaces or (b) the combination of the first load bearing surface and the second load bearing surface include a low friction coating or plating.

20. The domestic dishwasher according to claim 16, wherein the first load bearing surface and the second load bearing surface are substantially planar and the third load bearing surfaces are part of bars.

21. The domestic dishwasher according to claim 20, wherein a length of the bars are disposed perpendicular to a direction that the first rack slides out of the compartment.

22. The domestic dishwasher according to claim 20, wherein a length of the bars are disposed transverse to a direction that the first rack slides out of the compartment.

23. The domestic dishwasher according to claim 20, wherein the bars are substantially cylindrical.

24. The domestic dishwasher according to claim 16, wherein the third load bearing surfaces each comprise separate wires and the third load bearing surfaces are every portion of the separate wires that contact the first load bearing surface in the first position.

* * * * *